US005295810A

United States Patent [19]

Heijnen

[11] Patent Number: 5,295,810

[45] Date of Patent: Mar. 22, 1994

[54] APPARATUS FOR COMPRESSING A FLUID

[75] Inventor: Wilhelmus H. P. M. Heijnen, Assen, Netherlands

[73] Assignee: Shell Oil Company, Houston, Tex.

[21] Appl. No.: 88,492

[22] Filed: Jul. 6, 1993

Related U.S. Application Data

[63] Continuation of Ser. No. 765,791, Sep. 26, 1991, abandoned.

[30] Foreign Application Priority Data

Oct. 10, 1990 [GB] United Kingdom ..... 9022056

[51] Int. Cl.[5] ..... F04B 17/00

[52] U.S. Cl. ..... 417/408

[58] Field of Search ..... 417/408, 405, 406; 415/71, 72, 73

[56] References Cited

U.S. PATENT DOCUMENTS

| | | | |
|---|---|---|---|
| 1,693,102 | 11/1928 | Worthington | 417/408 |
| 2,113,213 | 4/1938 | Leonard | 417/408 |
| 2,397,139 | 3/1946 | Heaton . | |
| 2,516,442 | 7/1950 | Wolfe | 417/408 |
| 2,726,606 | 12/1955 | Davidson | 417/408 |
| 3,221,661 | 12/1965 | Swearingen | 415/72 |
| 3,695,173 | 10/1972 | Cox | 415/72 |
| 3,771,900 | 11/1973 | Baehr | 415/72 |
| 4,025,240 | 5/1977 | Matthews | 417/408 |
| 4,684,335 | 8/1987 | Goodridge | 418/189 |

FOREIGN PATENT DOCUMENTS

| | | |
|---|---|---|
| 389505 | 2/1924 | Fed. Rep. of Germany . |
| 912181 | 8/1946 | France . |
| 2057058 | 3/1981 | United Kingdom . |
| 2091322 | 7/1982 | United Kingdom . |

OTHER PUBLICATIONS

SPE Paper No. 8245, "Field Testing the Turbo-Lift Production System," by H. Petrie and J. W. Erickson, 1979.

*Primary Examiner*—Richard A. Bertsch
*Assistant Examiner*—Timothy S. Thorpe

[57] ABSTRACT

Apparatus for compressing a fluid comprising a tubular, open-ended housing (2) having a suction end (5) and a discharge end (6), a tubular, open-ended rotor (8) rotatably arranged in the housing (2), an annular driver space (17) which is defined between the inner surface of the housing (2) and the outer surface of the rotor (8), an annular seal preventing fluid flow from the annular driver space (17) to the suction end (5), a rotor driver (20) arranged in the annular driver space (17), and a rotor-driven compressor (30) arranged in the tubular rotor (8), wherein the rotor-driven compressor (30) includes a helical screw blade (32) which is secured to the inner surface of the tubular rotor (8), and wherein the pitch of the helical screw blade (32) decreases in the direction of the discharge end (6).

4 Claims, 2 Drawing Sheets

APPARATUS FOR COMPRESSING A FLUID

This is a continuation of application Ser. No. 765,791 filed Sept. 26, 1991, now abandoned.

FIELD OF THE INVENTION

This invention relates to an apparatus to compress fluids within a wellbore.

BACKGROUND OF THE INVENTION

The present invention relates recovering a fluid from an underground fluid-bearing formation, wherein a borehole extends from surface to the underground formation, and wherein the fluid is passed to surface through a tube extending through the borehole from the underground formation. In the specification the word "reservoir" will be used to denote an underground fluid-bearing formation. The fluid in the underground formation can be present in the form of a supercritical fluid, a gas, or a mixture of gas and liquid. The fluid can consist of carbon dioxide, natural gas or a mixture of hydrocarbons.

The present invention relates more in particular to an apparatus for compressing a fluid, which apparatus can be arranged in the lower end part of the tube which extends through the borehole.

U.S. Pat. No. 4,684,335 discloses an apparatus for compressing a fluid including a twin rotor screw compressor.

SPE Paper No. 8245, "Field Testing the Turbo-Lift Production System," by H. Petrie and J. W. Erickson, 1979, discloses a liquid poweered downhole liquid pump comprising an open-ended housing and a solid rotor arranged rotatably in the housing. Both the liquid-powered motor and the pump are staged turbines with blades arranged in the annular space between the housing and the solid rotor. The publication does not disclose an apparatus for compressing a fluid including a compressor arranged in a tubular rotor.

It is an object of the apparatus to provide an apparatus which is simpler than the known apparatus and which is furthermore less susceptible to wear at the high fluid flow rates which are encountered as gas is compressed.

SUMMARY OF THE INVENTION

To this end the apparatus for compressing a fluid according to the invention comprises a tubular, open-ended housing having a suction end and a discharge end, a tubular, open-ended rotor rotatably arranged in the housing, an annular driver space which is defined between the inner surface of the housing and the outer surface of the rotor, an annular seal preventing fluid flow from the annular driver space to the suction end, a rotor driver arranged in the annular driver space, and a rotor-driven compressor arranged in the tubular rotor, wherein the rotor-driven compressor includes a helical screw blade which is secured to the inner surface of the tubular rotor, and wherein the pitch of the helical screw blade decreases in the direction of the discharge end.

An advantage of the apparatus according to the invention is the relatively large cross-sectional area of the rotor interior through which the fluid to be compressed will pass. In addition there is no movement of the helical screw blade relative to the rotor.

BRIEF DESCRIPTION OF THE INVENTION

DETAILED DESCRIPTION OF THE INVENTION

Figure 1:
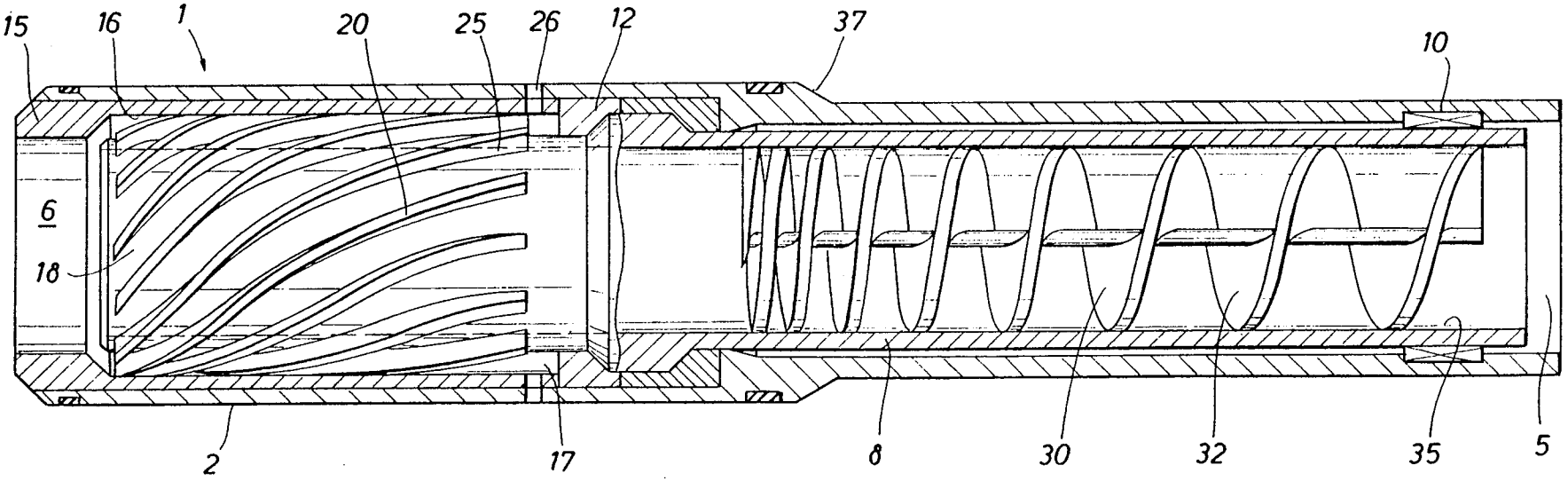
FIG. 1 shows schematically a partial longitudinal section of the apparatus according to the invention.

The apparatus 1 for compressing a fluid comprises a tubular, open-ended housing 2 having a suction end 5 and a discharge end 6. In the housing 2 is rotatably arranged a tubular, open-ended rotor 8. In FIG. 1 is shown a sectional view of the part of the tubular rotor 8 near the suction end 5 and a side view of the rotor part near the discharge end 6.

The tubular rotor 8 is supported in the housing 2 by a radial bearing 10 and by a bearing device 12. Bearing device 12 is a combination of a radial bearing, an axial bearing, and a seal. The bearing device 12 is secured in the housing by bushing 15 which itself is secured in the housing by means of conventional fastening devices (not shown). The inner surface 16 of the bushing 12 is part of the inner surface of the housing 2.

The apparatus further comprises an annular driver space 17 which is defined between the inner surface 16 of the housing 2 and the outer surface 18 of the tubular rotor 8. The annular driver space 17 is in fluid communication with the discharge end 6 of the housing 2. The bearing device 12 prevents fluid flow from the annular driver space 17 to the suction end 5.

A rotor driver in the form of fluid powered motor 20 is arranged in the annular driving space 17. The fluid powered motor 20 comprises a plurality of curved strips 25 of similar shape secured to the outer surface of the tubular rotor 8. The annular driving space 17 is provided with a power fluid inlet 26 debouching into the annular driver space 17 upstream to the fluid powered motor 20. The spacing of adjacent strips 25 is substantially the same. The shape of the curved strips 25 is so selected that during normal operation a fluid flowing through the annular driver space 17 causes the rotor 8 to rotate.

The apparatus further comprises a rotor-driven compressor 30 arranged in the tubular rotor 8. The compressor 30 includes a helical screw blade 32 which is secured to the inner surface 35 of the tubular rotor 8. To cause compression of gas the pitch of the helical screw blade 32 decreases in the direction of the discharge end 6. The shape of the helical screw blade is so selected that during normal operation the pressure along the helical screw blade of the fluid increases from the level at the suction end to the desired level at the discharge end of the apparatus.

Figure 2:
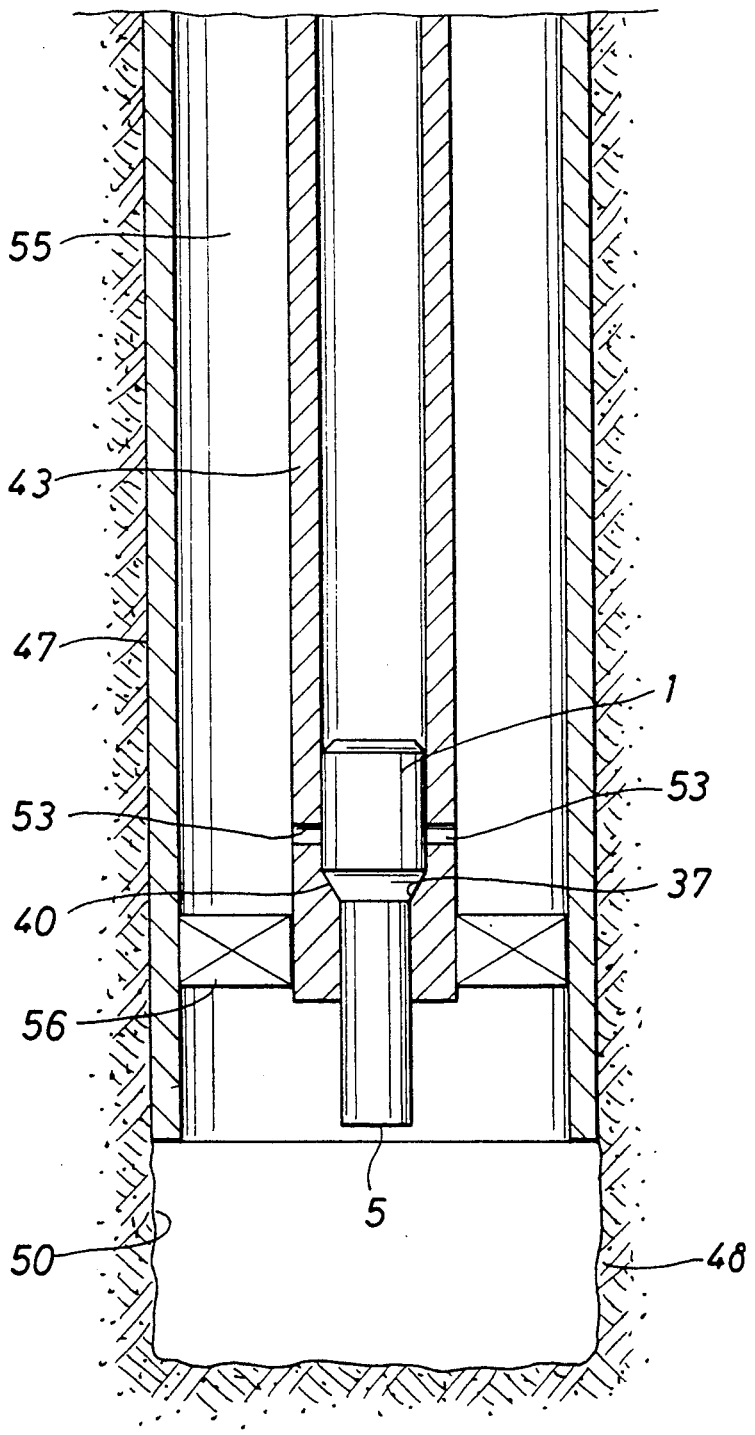
FIG. 2 shows schematically a partial longitudinal section of the lower end of a borehole provided with apparatus according to the invention.

The outer surface of the housing 2 is provided with a tapered section 37. Tapered section 37 can mate with a corresponding tapered section 40 (see FIG. 2) of the lower end of a tubing 43.

The tubing 43 is arranged in casing 47 which has been arranged in borehole 48 drilled toward reservoir 50. The tubing 43 is provided with apertures 53 which allow fluid communication from the annular space 55 between the casing 47 and the tubing 43 into the annular driver space 17 (see FIG. 1) via the power fluid inlet 26. To prevent fluid communication between the annular space 55 and the suction end 5 of the housing of the apparatus 1, a packer 56 is provided at the lower end of the tubing 43 to seal the annular space 55.

During normal operation, fluid flowing out of the reservoir 50 enters through the suction end 5 into the compressor 30. Driving fluid is supplied through the annular space 55 to the apertures 53 and 26 (see FIG. 1) into the annular driver space 17. The driving fluid powers motor 20 which in its turn drives the tubular rotor 8. Fluid collected in the lower part of the borehole 48, under the packer 56 is sucked into the suction end 5 of the apparatus 1 by the action of the rotating compressor. Fluid passes through the interior of the tubular rotor 8 toward the outlet end 6 where it is joined by driving fluid leaving the annular driver space 17. The mixture of compressed fluid and driver fluid flows through the tubing 43 to surface.

The number of turns per meter of the helical screw blade 32 of the compressor 30 is between 5 and 50.

In the embodiment as described with reference to FIG. 1 the rotor driver comprises a plurality of similar curved strips which are secured to the outer surface of the rotor. Alternatively the rotor driver includes a helical screw blade which is secured to the outer surface of the rotor. The number of turns per meter of the helical screw blade of the rotor driver is suitably between 4 and 48, and the number of helical screw blades is between two and four.

In an alternative embodiment of the invention the rotor driver is an electric motor. In this case permanent magnets are secured to the rotor and suitable magnetic coils are arranged along the inner surface of the housing. The magnetic coils are powered via electric conduits extending to an electric power supply.

I claim:

1. An apparatus for compressing a fluid comprising a tubular, open-ended housing having a suction end and a discharge end, a tubular, open-ended rotor rotatably arranged in the housing, an annular driver space which is defined between the inner surface of the housing and the outer surface of the rotor, an annular seal preventing fluid flow from the annular driver space to the suction end, a rotor driver arranged in the annular driver space, and a rotor-driven compressor arranged in the tubular rotor, wherein the rotor-driven compressor includes a helical screw blade which is secured to the inner surface of the tubular rotor, and wherein the pitch of the helical screw blade decreases in the direction of the discharge end, the pitch being the axial distance for each complete rotation of the helical screw blade.

2. The apparatus of claim 1 wherein the rotor driver is a fluid-powered motor arranged in the annular driver space which is in fluid communication with the discharge end and which is provided with a power fluid inlet debouching into the annular driver space upstream to the fluid-powered motor.

3. The apparatus of claim 2 wherein the fluid-powered motor comprises a plurality of similarly curved strips which are secured to the outer surface of the rotor so that the spacing between adjacent strips is substantially the same.

4. The apparatus of claim 2 wherein the fluid-powered motor includes a plurality of curved strips secured to the outer surface of the rotor.

* * * * *